US011350216B2

(12) United States Patent
Tagami et al.

(10) Patent No.: US 11,350,216 B2
(45) Date of Patent: May 31, 2022

(54) SPEAKER DIAPHRAGM AND SPEAKER APPARATUS

(71) Applicant: SONY CORPORATION, Tokyo (JP)

(72) Inventors: Takahisa Tagami, Kanagawa (JP); Emiko Ikeda, Tokyo (JP); Haruka Sakai, Tokyo (JP)

(73) Assignee: SONY CORPORATION, Tokyo (JP)

( * ) Notice: Subject to any disclaimer, the term of this patent is extended or adjusted under 35 U.S.C. 154(b) by 223 days.

(21) Appl. No.: 16/471,702

(22) PCT Filed: Dec. 5, 2017

(86) PCT No.: PCT/JP2017/043580
§ 371 (c)(1),
(2) Date: Jan. 27, 2020

(87) PCT Pub. No.: WO2018/142754
PCT Pub. Date: Aug. 9, 2018

(65) Prior Publication Data

US 2021/0368274 A1 Nov. 25, 2021

(30) Foreign Application Priority Data

Feb. 6, 2017 (JP) ..... JP2017-019483

(51) Int. Cl.
*H04R 11/02* (2006.01)
*H04R 9/02* (2006.01)
(Continued)

(52) U.S. Cl.
CPC ..... *H04R 9/027* (2013.01); *H04R 1/025* (2013.01); *H04R 7/10* (2013.01); *H04R 9/06* (2013.01)

(58) Field of Classification Search
CPC ..... H04R 9/06; H04R 1/2896; H04R 9/025; H04R 2400/11; H04R 7/26; H04R 1/2803; H04R 9/063
See application file for complete search history.

(56) References Cited

U.S. PATENT DOCUMENTS 6,658,133 B1 12/2003 Usuki et al.
6,868,165 B1 3/2005 Fabian
(Continued)

FOREIGN PATENT DOCUMENTS

CN 202035127 U 11/2011
CN 102957991 A 3/2013
(Continued)

OTHER PUBLICATIONS

Office Action for CN Patent Application No. 201780085040.2, dated Aug. 20, 2020, 06 pages of Office Action and 08 pages of English Translation.
(Continued)

*Primary Examiner* — Amir H Etesam
(74) *Attorney, Agent, or Firm* — Chip Law Group

(57) ABSTRACT

A speaker apparatus includes: a magnetic circuit including an annularly formed magnet, a yoke that includes a base surface part and a center pole part protruding from the base surface part, the center pole part being disposed while being inserted into a central part of the magnet, and a plate that is annularly formed and disposed on an outer peripheral side of the center pole part of the yoke while being attached to the magnet; a coil bobbin that is cylindrically formed and is displaceable in an axial direction of the center pole part while a part thereof is fitted onto the center pole part of the yoke; a voice coil that is wound around an outer peripheral surface of the coil bobbin, at least a part thereof being disposed in a magnetic gap formed between the plate and the center pole part of the yoke; and a diaphragm that is
(Continued)

connected to the coil bobbin and is caused to vibrate in conjunction with displacement of the coil bobbin, in which a first air passage path and a second air passage path are formed, the first air passage path leading from a back surface side of the diaphragm to a lower surface of the magnetic circuit, the second air passage path being formed in the lower surface of the magnetic circuit and connecting the first air passage path and a side of the magnetic circuit.

7 Claims, 13 Drawing Sheets

(51) Int. Cl.

| | |
|---|---|
| ***H04R 1/02*** | (2006.01) |
| ***H04R 7/10*** | (2006.01) |
| ***H04R 9/06*** | (2006.01) |

(56) References Cited

U.S. PATENT DOCUMENTS

| | | | | |
|---|---|---|---|---|
| 8,542,861 | B2 * | 9/2013 | Saiki | H04R 9/027 381/398 |
| 8,774,447 | B2 * | 7/2014 | Ko | H04R 19/02 381/396 |
| 2004/0037446 | A1 * | 2/2004 | Hasegawa | H04R 9/041 381/405 |
| 2006/0153413 | A1 | 7/2006 | Nakajima et al. | |
| 2007/0217645 | A1 * | 9/2007 | Ishihara | H04R 7/04 381/396 |
| 2011/0064261 | A1 * | 3/2011 | Kang | H04R 7/122 381/432 |
| 2015/0010197 | A1 | 1/2015 | Kawata et al. | |
| 2016/0345102 | A1 | 11/2016 | Tagami et al. | |

FOREIGN PATENT DOCUMENTS

| | | | |
|---|---|---|---|
| CN | 202818587 | U | 3/2013 |
| CN | 103716746 | A | 4/2014 |
| CN | 204131713 | U | 1/2015 |
| JP | 51-079337 | A | 6/1976 |
| JP | 51-079337 | U | 6/1976 |
| JP | 57-125097 | U | 8/1982 |
| JP | 64-027399 | A | 1/1989 |
| JP | 2001-231097 | A | 8/2001 |
| JP | 2005-005934 | A | 1/2005 |
| JP | 2007-251516 | A | 9/2007 |
| JP | 2010-063080 | A | 3/2010 |
| JP | 2010-226700 | A | 10/2010 |
| JP | 2011-101074 | A | 5/2011 |
| JP | 2013-046112 | A | 3/2013 |
| JP | 3187354 | U | 11/2013 |
| JP | 2016-129367 | A | 7/2016 |
| WO | 2013/137362 | A1 | 9/2013 |
| WO | 2015/115191 | A1 | 8/2015 |

OTHER PUBLICATIONS

International Search Report and Written Opinion of PCT Application No. PCT/JP2017/043580, dated Feb. 27, 2018,10 pages of ISRWO.

Office Action for JP Patent Application No. 2018-565966, dated Oct. 5, 2021, 05 pages of English Translation and 04 pages of Office Action.

* cited by examiner

SPEAKER DIAPHRAGM AND SPEAKER APPARATUS

CROSS REFERENCE TO RELATED APPLICATIONS

This application is a U.S. National Phase of International Patent Application No. PCT/JP2017/043580 filed on Dec. 5, 2017, which claims priority benefit of Japanese Patent Application No. JP 2017-019483 filed in the Japan Patent Office on Feb. 6, 2017. Each of the above-referenced applications is hereby incorporated herein by reference in its entirety.

TECHNICAL FIELD

The present technology relates to a speaker diaphragm and a speaker apparatus suitable for use in, for example, a speaker apparatus of a thin display.

BACKGROUND ART

In the case where a thin display is used as in a television receiver, it is desirable that a speaker apparatus as an audio reproduction apparatus has a thin configuration. One method of thinning the speaker apparatus is to use a flat diaphragm instead of a cone diaphragm. For example, the following Patent Literature 1 to Patent Literature 4 each describe a speaker apparatus using a flat diaphragm.

Further, Patent Literature 5 discloses a speaker apparatus in which a magnetic gap is filled with a magnetic fluid to eliminate the need for a damper. By omitting the damper, it is possible to thin the speaker apparatus.

CITATION LIST

Patent Literature

Patent Literature 1: Japanese Patent Application Laid-open No. 2011-101074

Patent Literature 2: Japanese Patent Application Laid-open No. 2010-226700

Patent Literature 3: Japanese Patent Application Laid-open No. 2010-063080

Patent Literature 4: Japanese Patent Application Laid-open No. 1989-027399

Patent Literature 5: Japanese Patent Application Laid-open No. 2013-046112

DISCLOSURE OF INVENTION

Technical Problem

Patent Literature 1 describes a structure relating to an electrodynamic loudspeaker including a flat diaphragm. However, with the structure described in Patent Literature 1, there is a problem that the peak dip of the sound pressure frequency characteristics is large because the resonance mode of the diaphragm cannot be suppressed.

Patent Literature 2 describes a structure in which a flat diaphragm is driven by a plurality of rectangular voice coils to achieve flat frequency characteristics. In this configuration, the plurality of voice coils for driving the entire surface of the diaphragm are necessary, which increases the weight of the vibration system and reduces the reproduction efficiency. Further, one magnetic circuit is necessary for one voice coil, which makes the structure complicated.

Patent Literature 3 discloses a structure in which a long-shaped track-type voice coil is disposed on a diagonal of a parallelogram flat diaphragm to suppress the peak dip of frequency characteristics. The content corresponds to only a specific parallelogram, and there is a problem that there is no freedom in the diaphragm shape.

Patent Literature 4 discloses that a rectangular flat diaphragm is driven by a frustoconical drive cone on top of a voice coil to achieve flat frequency characteristics. However, the content is to reduce the first resonance mode of the rectangular flat diaphragm, and the effect on the wide band is low. Further, since a signal is transmitted via the frustoconical drive cone, the performance degradation due to transmission loss is large.

Further, Patent Literature 5 aims at suppression of scattering of the filled magnetic fluid, and it is not sufficient for thinning.

Therefore, it is an object of the present technology to provide a speaker diaphragm capable of reducing the peak dip of the sound pressure frequency characteristics due to divided vibration to achieve flat characteristics even though it is a flat diaphragm, and can be thinned as compared with the existing one by releasing the pressure on the back surface of the diaphragm to the outer circumferential direction instead of the rear of the speaker, and a speaker apparatus.

Solution to Problem

The present technology is a speaker diaphragm, including: a first flat diaphragm; and a second flat diaphragm bonded to a back surface of the first flat diaphragm, the second flat diaphragm having an area smaller than that of the first flat diaphragm and being formed of a material whose physical characteristics are different from those of the first flat diaphragm.

Further, the present technology is a speaker apparatus, including:

a magnetic circuit including an annularly formed magnet, a yoke that includes a base surface part and a center pole part protruding from the base surface part, the center pole part being disposed while being inserted into a central part of the magnet, and a plate that is annularly formed and is disposed on an outer peripheral side of the center pole part of the yoke while being attached to the magnet;

a coil bobbin that is cylindrically formed and is displaceable in an axial direction of the center pole part while a part thereof is fitted onto the center pole part of the yoke;

a voice coil that is wound around an outer peripheral surface of the coil bobbin, at least a part thereof being disposed in a magnetic gap formed between the plate and the center pole part of the yoke; and a diaphragm that is connected to the coil bobbin and is caused to vibrate in conjunction with displacement of the coil bobbin, in which a first air passage path and a second air passage path are formed, the first air passage path leading from a back surface side of the diaphragm to a lower surface of the magnetic circuit, the second air passage path being formed in the lower surface of the magnetic circuit and connecting the first air passage path and a side of the magnetic circuit.

Advantageous Effects of Invention

In accordance with at least one embodiment, the present technology is capable of achieving flat sound pressure frequency characteristics by bonding two flat diaphragms together. Further, by releasing the pressure on the back surface of the diaphragm to the outer circumferential direction instead of the rear of the speaker, it is possible to achieve thinning. It should be noted that the effect described here is not necessarily limitative and may be any effect described in the present disclosure or an effect different therefrom.

MODE(S) FOR CARRYING OUT THE INVENTION

Hereinafter, an embodiment and the like of the present technology will be described with reference to the drawings. Note that description will be made in the following order.

<1. Embodiment>

<2. Modified Example>

The embodiment and the like described below are favorable specific examples of the present technology, and the content of the present technology is not limited to the embodiment and the like.

Further, in the following description, in order to prevent the illustration from being complicated, only a part of the configurations is denoted by a reference symbol and a part of the configurations is simplified in some cases.

1. Embodiment

Figure 1:
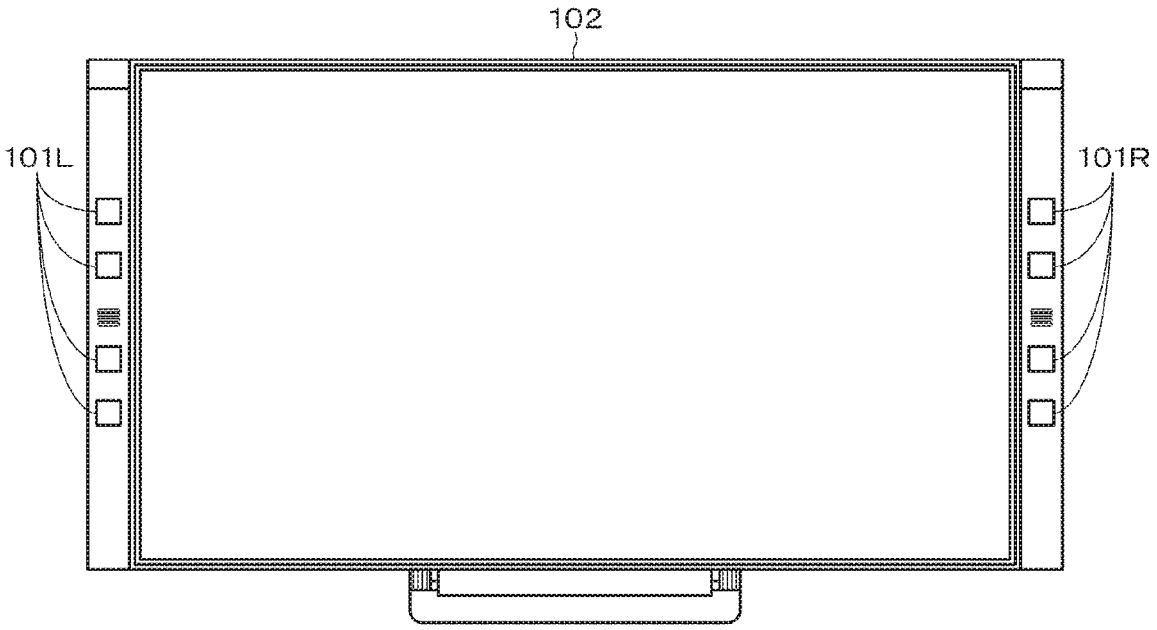
FIG. 1 is a schematic diagram showing an example of use of an embodiment of the present technology.

Hereinafter, an embodiment of the present technology will be described in detail. As shown in FIG. 1, a plurality of speakers 101L and 101R are respectively incorporated in left and right bezels of a thin panel television apparatus 102. The thickness of each of the speakers 101L and 101R is designed to be smaller than that thickness of the thin panel television apparatus 102. The plurality of speakers 101L and 101R each include a tweeter, a woofer, and a subwoofer. For example, the woofer and subwoofer are each configured to use a magnetic fluid. The present technology is applicable to the woofer and subwoofer.

Figure 2:
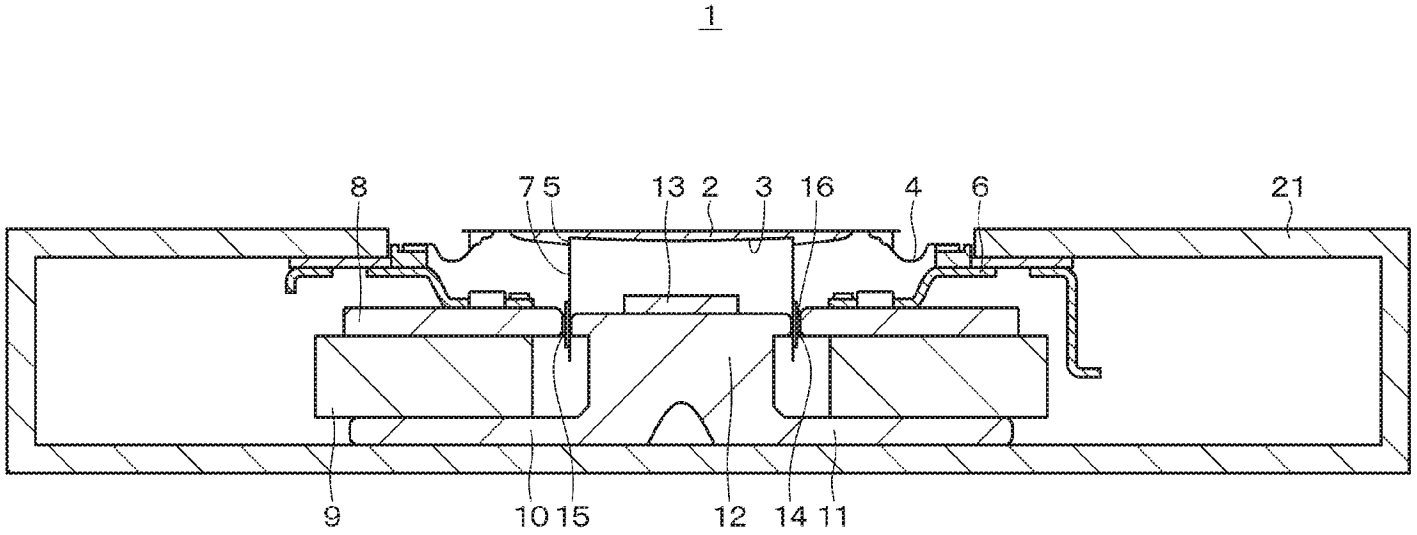
FIG. 2 is a cross-sectional view of the embodiment of the present technology.
Figure 3A:
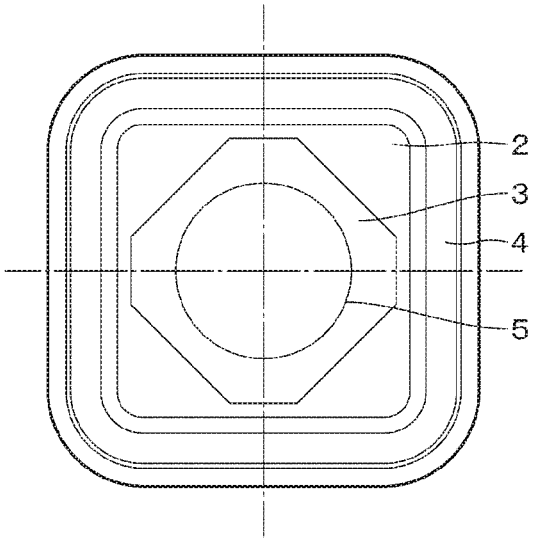
FIGS. 3A, 3B, and 3C are plan view, an exploded view, and a side view of a speaker diaphragm.
Figure 3B:
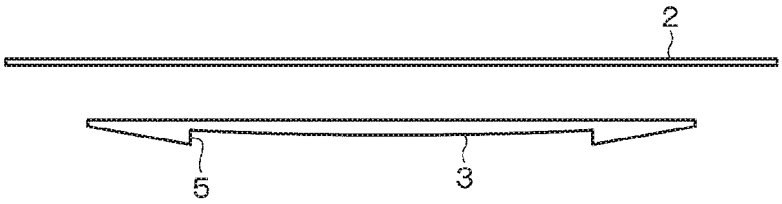
Figure 3C:
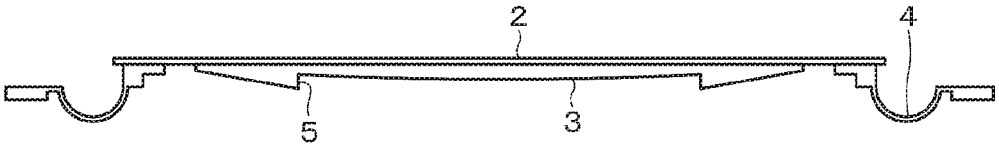

FIG. 2 is a cross-sectional view of a speaker apparatus 1 according to the embodiment of the present technology. The speaker apparatus 1 includes a flat speaker diaphragm. The speaker diaphragm has a 2-layer structure in which two flat diaphragms 2 and 3 are bonded together, as shown in FIGS. 3A 3B, and 3C. On the front surface side (sound radiation side) of the speaker apparatus, for example, the substantially square flat diaphragm 2 is disposed. To the back surface of the flat diaphragm 2, the diaphragm 3 that is formed of a material different from that of the flat diaphragm 2 and has an area smaller than that of the flat diaphragm 2 is bonded. The diaphragm 3 has, for example, an octagonal shape. Note that details of the speaker diaphragm in which the flat diaphragms 2 and 3 are bonded together will be described below.

An edge 4 is attached to the outer periphery of the flat diaphragm 2, and the speaker diaphragm is attached to a frame 6 via the edge 4. A circular recess is formed at the center of the flat diaphragm 3, and a step 5 is formed around the recess. To the step 5, an end of a coil bobbin 7 is bonded.

A plate 8 formed of a magnetic material is attached to the frame 6. The plate 8 is formed in a thin and substantially annular shape. To the rear surface of the plate 8, an annularly formed magnet 9 is attached. To the rear surface of the magnet 9, a yoke 10 is attached.

The yoke 10 is formed by integrally forming a disk-shaped base surface part 11 and a center pole part 12 protruding forward from the central part of the base surface part 11, and the center pole part 12 is formed in, for example, a cylindrical shape. Note that the base surface part 11 and the center pole part 12 can be separately provided in some cases. In this case, the plate corresponding to the base surface part 11 is referred to as a back plate. The front surface of the base surface part 11 of the yoke 10 is attached to the rear surface of the magnet 9. The inner surface of the back plate of an enclosure 21 formed of a non-magnetic material such as a synthetic resin and aluminum is in close proximity to or in close contact with the back surface of the base surface part 11 of the yoke 10. The enclosure 21 supports the speaker apparatus 1 via the frame 6.

The plate 8, the magnet 9, and the yoke 10 are coupled with the central axes matching. The yoke 10 is disposed while, for example, a magnetic flux change part 13 added to the front end surface of the center pole part 12 protrudes forward from the plate 8, and a space between the plate 8 and the center pole part 12 is formed as a magnetic gap 14.

The coil bobbin 7 is supported by the center pole part 12 of the yoke 10 so as to be displaceable (movable) in the front-read direction, i.e., in the axial direction of the center pole part 12. The coil bobbin 7 is cylindrically formed, and a voice coil 15 is wound around the outer peripheral surface on the rear end side of the coil bobbin 7. At least a part of the voice coil 15 is disposed in the magnetic gap 14. The voice coil 15 is disposed in the magnetic gap 14, and thus, the plate 8, the magnet 9, the yoke 10, and the voice coil 15 constitute the magnetic circuit.

The magnetic gap 14 is filled with a magnetic fluid 16. The magnetic fluid 16 is prepared by dispersing magnetic fine particles in water or oil using a surfactant, the saturation magnetic flux thereof is, for example, 30 mT (millitesla) to 40 mT, and the viscosity thereof is not more than 300 cP (centipoise) (=0.3 Pa·s (pascal·second)).

Figure 4A:
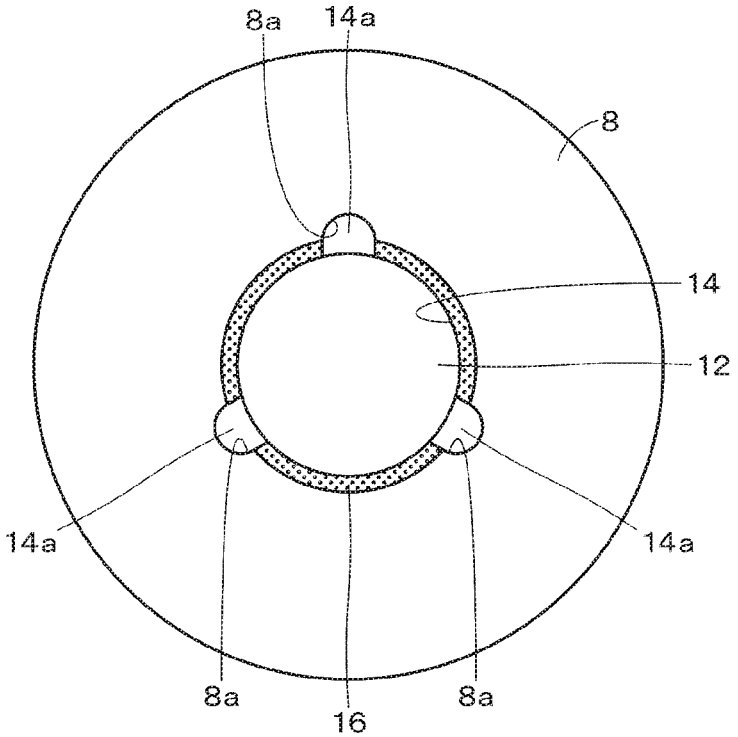
FIGS. 4A and 4B are each an enlarged front view showing a magnetic gap filled with a magnetic fluid.

As shown in FIG. 4A, for example, three recesses are formed to be separated on the inner peripheral surface of the plate 8 at equal intervals in the circumferential direction, and these recesses are formed as magnetic flux change parts 8*a*, 8*a*, and 8*a*. The magnetic flux change parts 8*a*, 8*a*, and 8*a* are each formed to extend in the front-read direction. Each of the magnetic flux change parts 8*a*, 8*a*, and 8*a* is formed to have a cross-sectional shape perpendicular to the axial direction being a substantially semicircular shape. However, for example, each of the magnetic flux change parts 8*a*, 8*a*, and 8*a* may be formed to have a cross-sectional shape perpendicular to the axial direction being another shape such as a triangular shape and a rectangular shape. Note that the number of magnetic flux change parts 8*a* is arbitrary, and may be not more than two or not less than four.

Figure 4B:
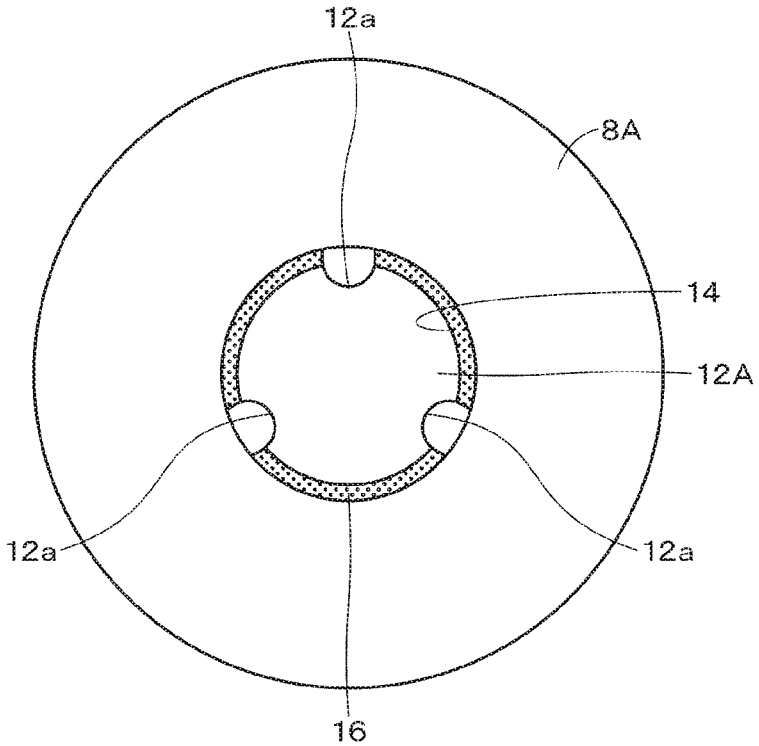

FIG. 4B shows a modified example, and for example, three recesses are formed to be separated on the outer peripheral surface of the center pole part 12A at equal intervals in the circumferential direction. These recesses are formed as magnetic flux change parts 12*a*, 12*a*, and 12*a*. Note that the magnetic flux change parts 8*a* may be formed on the inner peripheral surface of the plate 8, and the magnetic flux change parts 12*a* may be formed on the outer peripheral surface of the center pole part 12A.

As described above, the magnetic flux change parts 8*a*, 8*a*, and 8*a* are formed on the plate 8 (see FIG. 4A). The magnetic flux change parts 8*a*, 8*a*, and 8*a* of the plate 8 have a function of forming magnetic gradients Sa, Sa, . . . that change the magnetic flux density of the magnetic gap 14 in the circumferential direction to change magnetic force on the magnetic fluid 16 (see FIG. 5). Therefore, the magnetic fluid 16 filled in the magnetic gap 14 is held at a portion where the magnetic flux density is high, and air gaps 14*a*, 14*a*, and 14*a* are formed between the outer peripheral surface of the center pole part 12 and the inner peripheral surface of the plate 8 in the part where the magnetic flux change parts 8*a*, 8*a*, and 8*a* are formed (see FIG. 4A).

Figure 5:
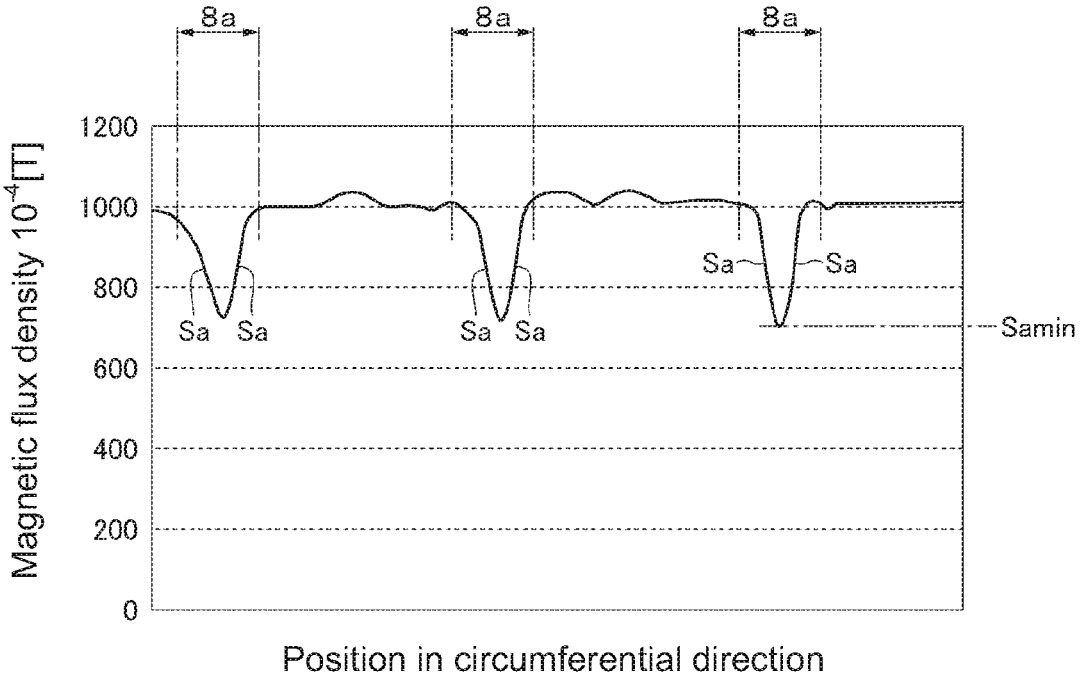
FIG. 5 is a graph showing a magnetic flux density in a circumferential direction of the magnetic gap.

FIG. 5 is a graph showing the magnetic flux density in the circumferential direction of the magnetic gap 14. As shown in FIG. 5, in the part of the plate 8 where the magnetic flux change parts 8*a*, 8*a*, and 8*a* are formed, the magnetic flux change parts 8*a*, 8*a*, and 8*a* form magnetic gradients (inclined parts) Sa, Sa, . . . , and the magnetic force is smaller than those of other parts. The magnetic gradients Sa indicate the change in magnetic flux density in which there is magnetic force but the magnetic force is reduced as it approaches the center in the circumferential direction of the magnetic flux change part 8*a*.

Also the magnetic flux change parts 12*a*, 12*a*, and 12*a* formed in the center pole part 12A function similarly to the above-mentioned magnetic flux change parts 8*a*, 8*a*, and 8*a* and form magnetic gradients.

Further, in the speaker apparatus 1, as described above, the magnetic flux change part 13 is formed in the center pole part 12 of the yoke 10. The magnetic flux change part 13 of the center pole part 12 has a function of forming a magnetic gradient Sb that changes a magnetic flux density in the axial direction, i.e., the displacement direction of the coil bobbin 7 to change magnetic force on the magnetic fluid 16 (see FIG. 6).

Figure 6:
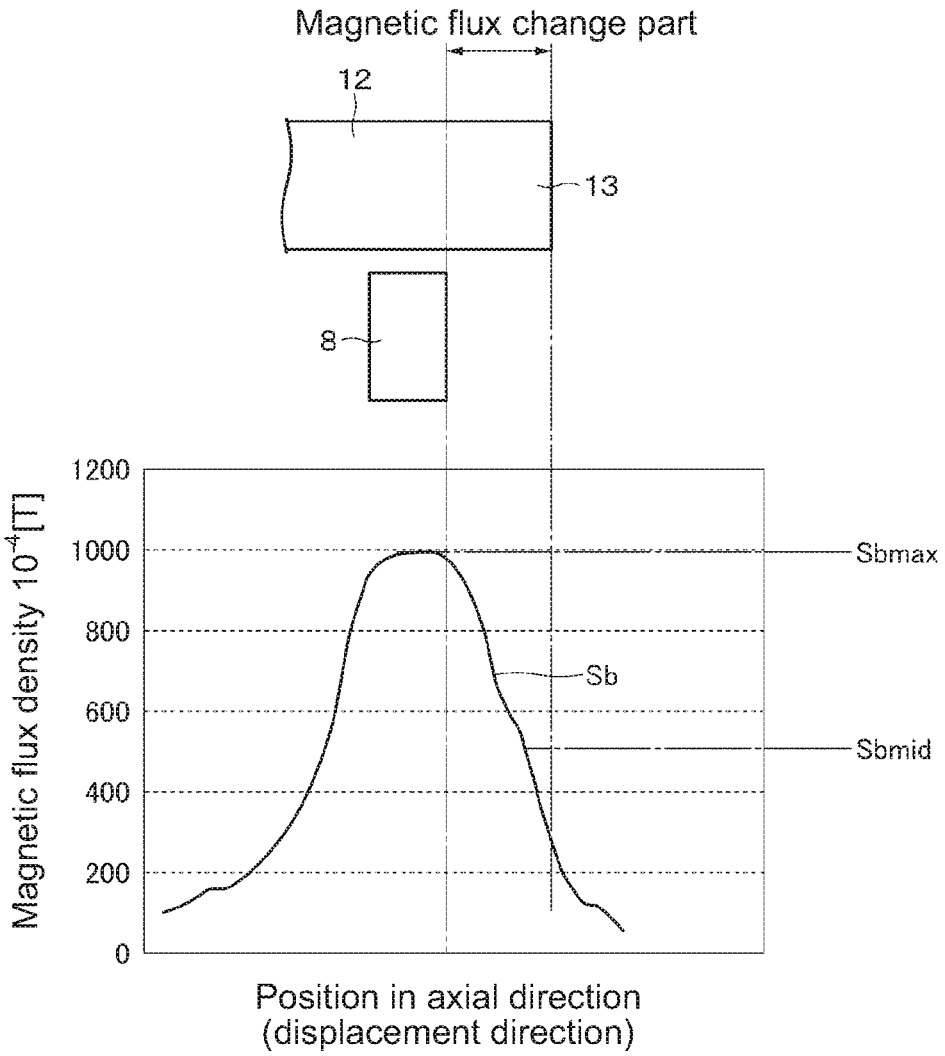
FIG. 6 is a graph showing a magnetic flux density in an axial direction of the magnetic gap.

FIG. 6 is a graph showing the magnetic flux density in the axial direction. As shown in FIG. 6, in the part of the center pole part 12 where the magnetic flux change part 13 is formed, the magnetic flux change part 13 form the magnetic gradient (incline part) Sb, and magnetic force is smaller than that of a part that the plate 8 faces. The magnetic gradient Sb indicates a change in magnetic flux density in which there is magnetic force but the magnetic force is reduced as it is away from the plate 8.

Note that in the speaker apparatus 1, the minimum value Samin (see FIG. 5) of the magnetic flux density in the circumferential direction is made larger than a value Sbmid (see FIG. 6) that is half the maximum value Sbmax (see FIG. 6) of the magnetic flux density in the axial direction.

In the speaker apparatus 1 configured as described above, when a drive voltage or drive current is supplied to the voice coil 15, a thrust is generated in the magnetic circuit, the coil bobbin 7 is displaced in the front-rear direction (axial direction), and the flat diaphragms 2 and 3 are caused to vibrate in conjunction with the displacement of the coil bobbin 7. At this time, audio proportional to the voltage or current is output.

At the time of audio output, force that causes the magnetic fluid 16 filled in the magnetic gap 14 to be scattered is applied to the magnetic fluid 16 in conjunction with the displacement of the coil bobbin 7. However, in the speaker apparatus 1, the magnetic flux change parts 8*a*, 8*a*, and 8*a* of the plate 8 form the magnetic gradients Sa, Sa, . . . that change magnetic force on the magnetic fluid 16 in the circumferential direction. Further, the minimum value Samin of the magnetic flux density in the circumferential direction is made larger than the value Sbmid that is half the maximum value Sbmax of the magnetic flux density in the axial direction.

Therefore, a part of the magnetic fluid 16 to be scatted in the axial direction or circumferential direction is attracted to the magnetic gap 14 from the air gaps 14*a*, 14*a*, and 14*a* that are parts where the magnetic gradients Sa, Sa, . . . are formed, which have magnetic force, and the scattering is suppressed. Further, a part of the magnetic fluid 16 to be scattered in the axial direction is attracted to the magnetic gap 14 from the part where the magnetic gradient Sb, which has magnetic force, and the scattering is suppressed.

Figure 7A:
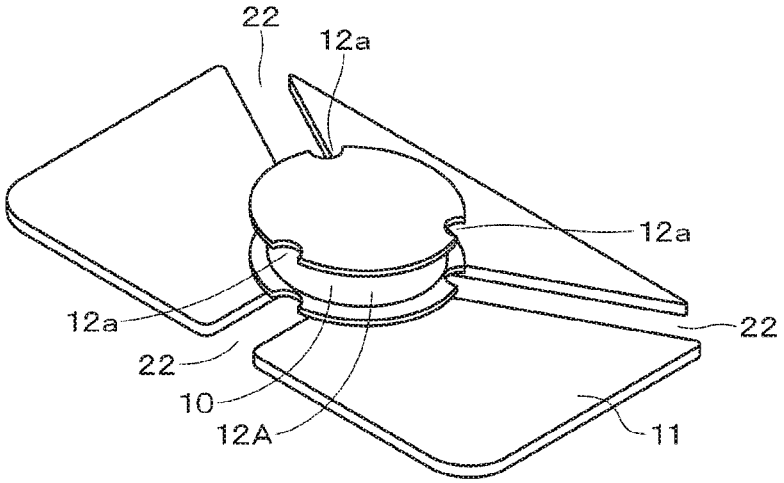
FIGS. 7A and 7B are respectively a perspective view and a plan view of an example of a yoke.
Figure 7B:
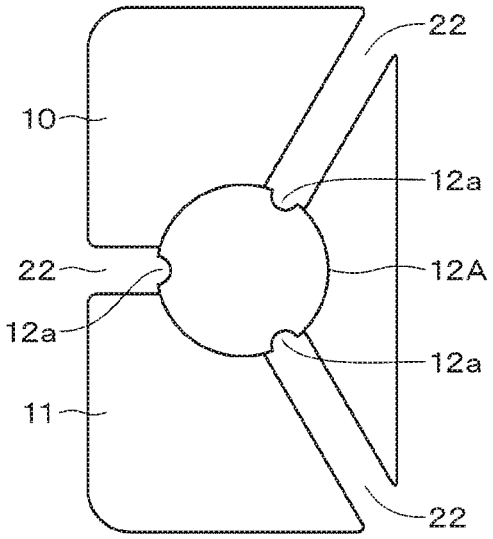

FIGS. 7A and 7B are perspective view and a plan view of an example of the yoke 10. For example, three recesses are formed to be separated in the circumferential direction on the outer peripheral surface of the center pole part 12A at equal intervals, and these recesses are formed as the magnetic flux change parts 12*a*, 12*a*, and 12*a* (see FIG. 4B). The magnetic flux change part 12*a* forms a first air passage path leading from the back surface side of the flat diaphragms 2 and 3 to the magnetic circuit, e.g., the lower surface of the base surface part 11 of the yoke 10.

A notch 22 that extends outward from the position of each of the magnetic flux change parts 12*a* is formed in the base surface part 11 of the yoke 10. In the case where the magnetic flux change parts 12*a* are formed at equal intervals of 120°, three notches 22 that radially extend toward the outer periphery of the base surface part 11 are formed starting from the position on the side of the center pole part 12A of the base surface part 11 that matches each of the magnetic flux change part 12. The magnet 9 on the upper surface side of the base surface part 11 is disposed, and the back surface plate of the enclosure is disposed in close contact with the bottom surface side. Therefore, the upper and lower surfaces of the notch 22 are closed, and the notch 22 forms a hole having a rectangular cross section. That is, a second air passage path that connects the first air passage path and a side of the base surface part 11 is formed.

Figure 8:
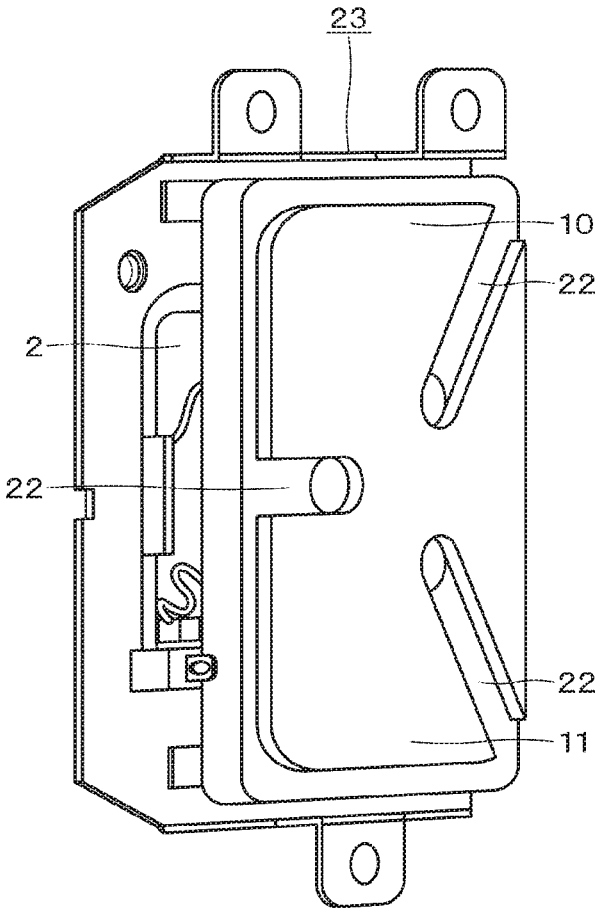
FIG. 8 is a perspective view of a speaker unit.

A perspective view of a speaker unit 23 to which such a yoke 10 is attached seen from the back surface is shown in FIG. 8. The speaker unit 23 in FIG. 8 is attached to the enclosure 21 (omitted in FIG. 8) thereby assembling the speaker apparatus 1. By the above-mentioned first and second air passage paths, the back pressure generated when the flat diaphragms 2 and 3 and the coil bobbin 7 are displaced can be released well.

That is, when the flat diaphragms 2 and 3 are displaced, compression waves of the opposite phase to the emitted sound are generated on the back surface of the flat diaphragms 2 and 3. When air is pushed on the back surface, a back pressure is generated. The back pressure is reflected by the back plate of the enclosure and acts on the speaker unit, which causes deterioration of characteristics of the speaker apparatus. The notch 22 forms a hole because the rear surface of the magnet 9 is located on the front surface of the base surface part 11 of the yoke 10 and the back plate of the enclosure 21 is located on the bottom surface side of the base surface part 11. This hole guides the back pressure and releases it from the side of the magnetic circuit in the side plate direction of the enclosure 21. Therefore, in accordance with the present technology, it is possible to reduce the influence of the back pressure generated by the flat diaphragms 2 and 3 and/or the coil bobbin 7 to make the characteristics of the speaker apparatus excellent although it has a thinned structure.

In an embodiment, in a configuration in which the magnetic gap 14 is filled with the magnetic fluid 16, as the magnetic flux change part 8*a* for preventing the magnetic fluid 16 from being scattered, a plurality of recesses are formed in the plate 8 and/or the center pole part 12 of the yoke 10. Since the magnetic fluid 16 is not held in this recess, the recess and the notch 22 can be communicated to function as a path for the back pressure (air) to be released. Therefore, it is not necessary to increase the distance between the rear side of the speaker unit and the back plate of the enclosure unlike the case where the back pressure is released just behind the speaker unit, and the speaker apparatus can be thinned. Further, as described above, since the back pressure is released using the magnetic flux change part 8*a* for forming the magnetic gradient, the trouble of processing the plate 8 and/or the yoke 10 is reduced.

Figure 9A:
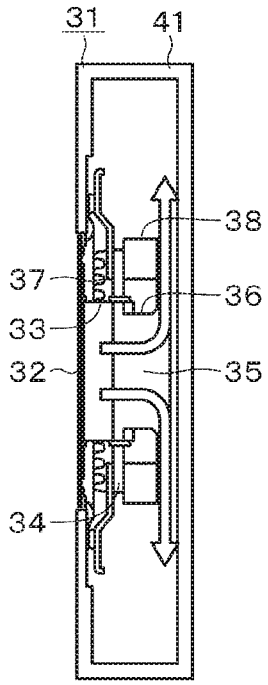
FIGS. 9A and 9B are respectively a cross-sectional view of another example of the present technology, and a bottom view of a yoke.
Figure 9B:
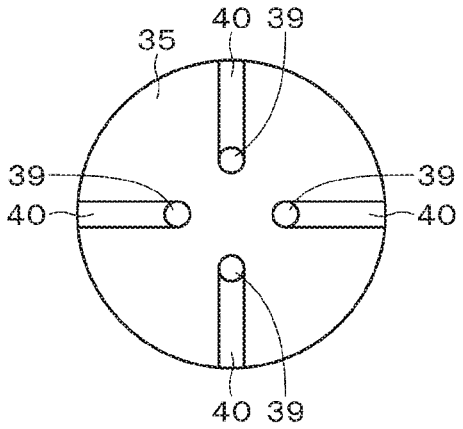

Further, the present technology is applicable also to a speaker apparatus that does not use a magnetic fluid. In a speaker apparatus 31 shown in FIGS. 9A and 9B, a voice coil is wound around the outer peripheral surface of a coil bobbin 33 attached to a flat diaphragm 32. The voice coil is disposed in a magnetic gap between a plate 34 and a center pole part 36 of a yoke 35. A damper 37 is attached to the coil bobbin 33. An annularly formed magnet 38 is attached to the rear surface of the plate 34. The yoke 35 is attached to the rear surface of the magnet 38.

A plurality of, e.g., four through holes 39 penetrating the center pole part 36 of the yoke 35 in the front-rear direction are formed at equal intervals. The through hole 39 form the first air passage path. A notch 40 (second air passage path) that extends to the outer periphery in the radial direction is formed on the base surface part of the yoke 35 starting from the through holes 39. The back pressure of the speaker apparatus 31 is directed to the side plate of an enclosure 41 from a side of the yoke 35 through the through holes 39 and the notch 40. Therefore, it is possible to reduce the dimension in the front-read direction of the speaker apparatus 31 to achieve a thin structure.

Figure 10A:
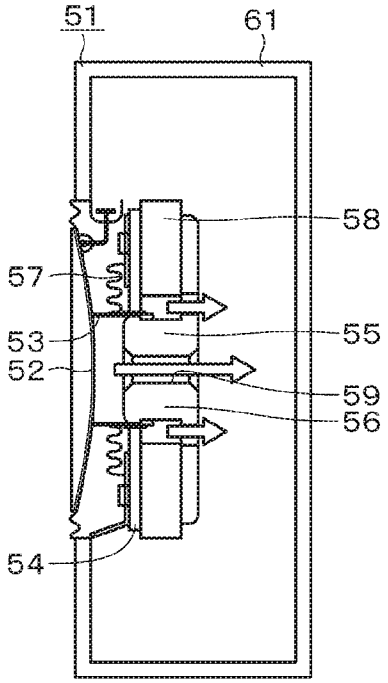
FIGS. 10A and 10B are respectively a cross-sectional view of an existing speaker apparatus, and a bottom view of a yoke.
Figure 10B:
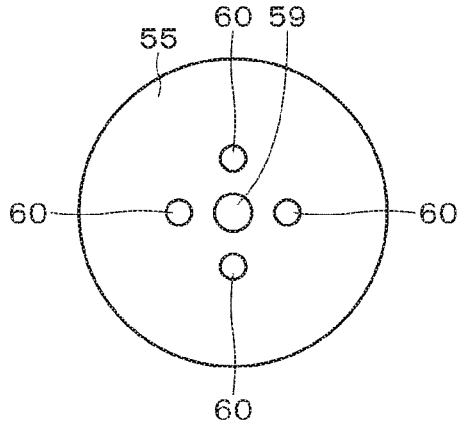

FIGS. 10A and 10B each show an existing speaker apparatus 51 as a comparative example. In the speaker apparatus 51, a voice coil is wound around the outer peripheral surface of a coil bobbin 53 attached to a diaphragm 52. The voice coil is disposed in a magnetic gap between a plate 54 and a center pole part 56 of a yoke 55. A damper 57 is attached to the coil bobbin 53. An annularly formed magnet 58 is attached to the rear surface of the plate 54. The yoke 55 is attached to the rear surface of the magnet 58.

As shown in FIG. 10B, a hole 59 penetrating the center position of the yoke 55 back and forth, and four holes 60 penetrating the yoke 55 through the gap between the center pole part 56 behind the magnetic gap and the magnet 58. The holes 60 are formed at intervals of 90°. The back pressure of the diaphragm 52 and the coil bobbin 53 is released behind the speaker unit through these holes 55 and 59. In such a configuration, it is necessary to increase the distance of an enclosure 61 behind the speaker unit to the back surface plate to reduce the influence of the back pressure. Therefore, there is a problem that thinning is difficult as compared with the present technology.

Figure 11A:
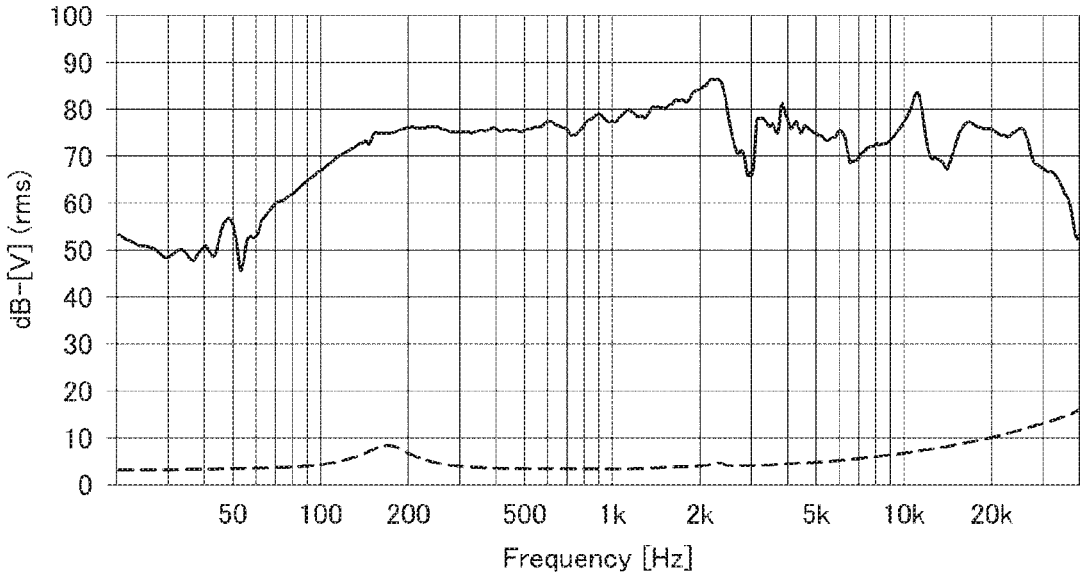
FIGS. 11A and 11B are each a graph showing sound pressure frequency characteristics and impedance characteristics.

In general, it is advantageous to make the diaphragm flat for thinning the speaker apparatus, but the diaphragm having a flat shape generates a large number of vibration resonance modes, which causes peak dip in the frequency characteristics. In of FIG. 11A, sound pressure frequency characteristics (solid line) and impedance characteristics (broken line) of a speaker apparatus using a general flat diaphragm are shown. For example, sound pressure frequency characteristics are disturbed around 2 kHz and around a frequency slightly higher than 10 kHz.

In the above-mentioned embodiment of the present technology, as described with reference to FIGS. 3A, 3B, and 3C, flat sound pressure frequency characteristics are achieved by a 2-layer structure in which one flat diaphragm is bonded to the other flat diaphragm having an area significantly different from that of the one flat diagram, the flat diaphragms being formed of two or more types of materials having different physical characteristics. A structure including a 2-layer structure part and a 1-layer structure part in the diaphragm area is achieved. As an example, the area of the flat diaphragm 2 of the first layer is approximately 1400 mm2, and the area of the flat diaphragm 3 of the second layer is approximately 650 mm2. Since the resonance mode is dispersed, flat characteristics are achieved by optimizing the area ratio. The material physical characteristics/size of the diaphragm/shape of the diaphragm relate to the area ratio, and the area ratio can be optimized by FEM (Finite Element Analysis) simulation or CAE (Computer Aided Engineering).

Figure 11B:
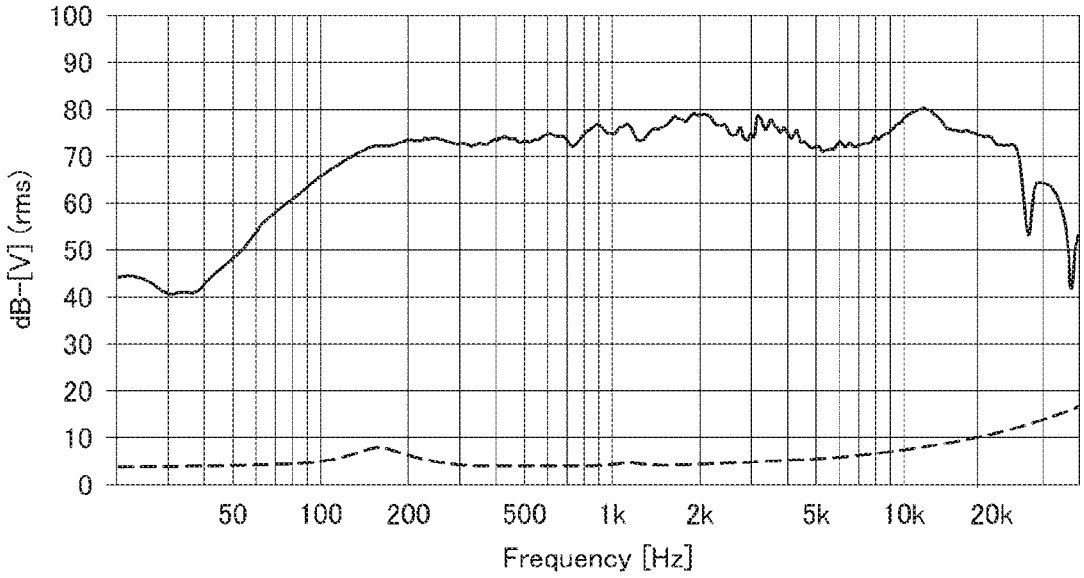

CFRP (Carbon Fiber-Reinforced Plastics) is used for the flat diaphragm 2 in FIGS. 3A, 3B, and 3C, foam mica is used for the flat diaphragm 3, and rubber is used for the edge 4. The foam mica is a material obtained by molding mica flakes into a formed cell shape and blending pulp and synthetic fibers to increase the strength, and is a material that can be molded and processed. Sound pressure frequency characteristics and impedance characteristics of the embodiment of the present technology using such a diaphragm are shown in FIG. 11B. It is possible to suppress the disturbance of the characteristics observed in the sound pressure frequency characteristics shown in FIG. 11A, and achieve flat sound pressure frequency characteristics. As a specific example of the speaker diaphragm, in addition to the example described above, those in which CFRP is used for the flat diaphragm 2 and a paper is used for the flat diaphragm 3, those in which aluminum is used for the flat diaphragm 2 and foam mica is used for the flat diaphragm 3, and the like can be used.

As in these examples, it is favorable that diaphragms to be bonded together have different physical characteristics. As the material of each of the flat diaphragms 2 and 3, in addition to the above-mentioned materials, a resin material such as PP (polypropylene), and an acoustic material such as aluminum and a paper can be used. Examples of the physical characteristics to be considered include the specific gravity, the Young's modulus, the speed of sound, and the internal loss. In the Table 1 below, main physical characteristics of the diaphragm material are shown. Note that the structure it not limited to the 2-layer structure, and may be a three-or-more-layer structure. For example, as the materials of the diaphragms to be bonded together, those having different Young's modulus as much as possible are selected.

TABLE 1

| | CFRP | Foam mica | Aluminum | Paper | PP |
|---|---|---|---|---|---|
| Specific gravity | 0.83 | 0.34 | 2.7 | 0.6 | 0.91 |
| Young's modulus Gpa | 8.33 | 5.3 | 70 | 1.50 | 3.77 |
| Speed of sound m/s | 3044 | 3900 | 5090 | 1600 | 2040 |
| Internal loss 1/tan δ | 66 | 50 | 300 | 20 | 26 |

Figure 12:
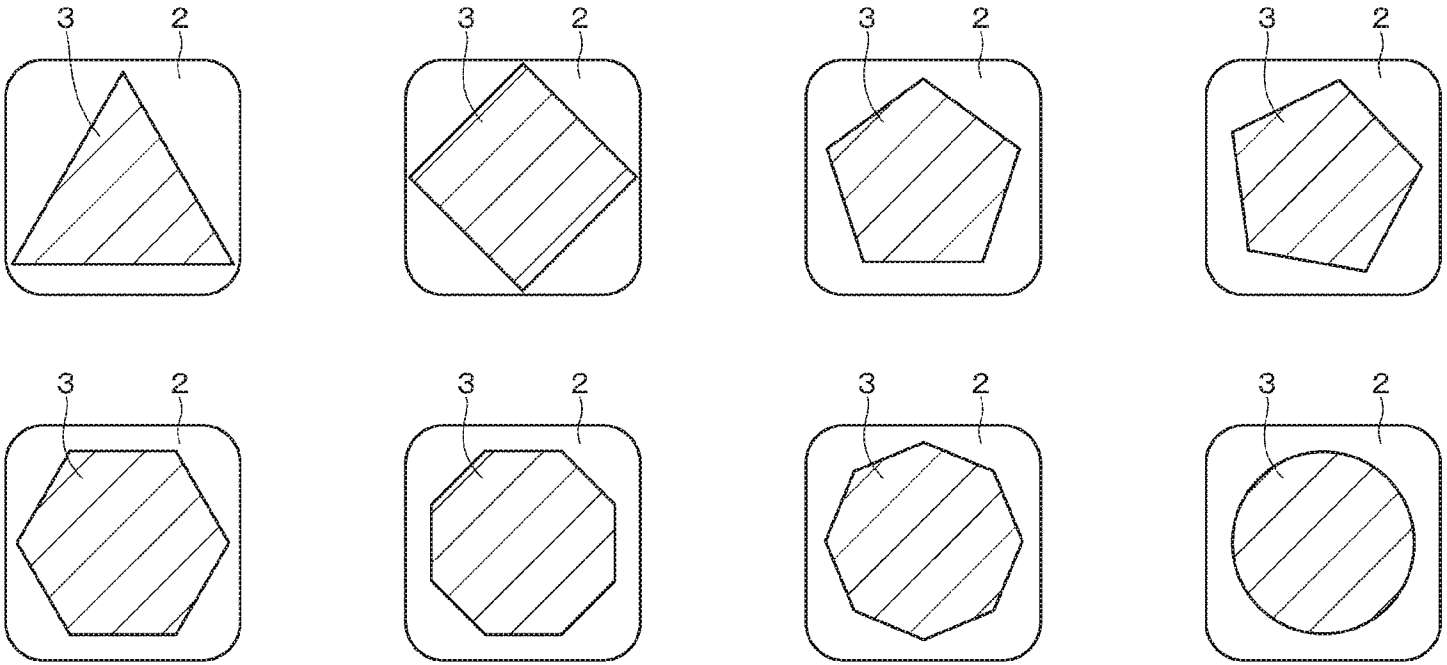
FIG. 12 is a schematic diagram showing a plurality of examples of the shape of a speaker diaphragm.

In the configuration in FIGS. 3A, 3B, and 3C, the flat diaphragm 2 of the first layer is a flat square, and the flat diaphragm 3 of the second layer is a three-dimensional octagon. However, other shapes can be used. As shown in FIG. 12, in the case where the flat diaphragm 2 is a quadrangle, the flat diaphragm 3 (indicated by the hatched area) can have various shapes. That is, the flat diaphragms 3 can have a shape such as a triangle, a quadrangle, a polygon, and a circle.

Figure 13:
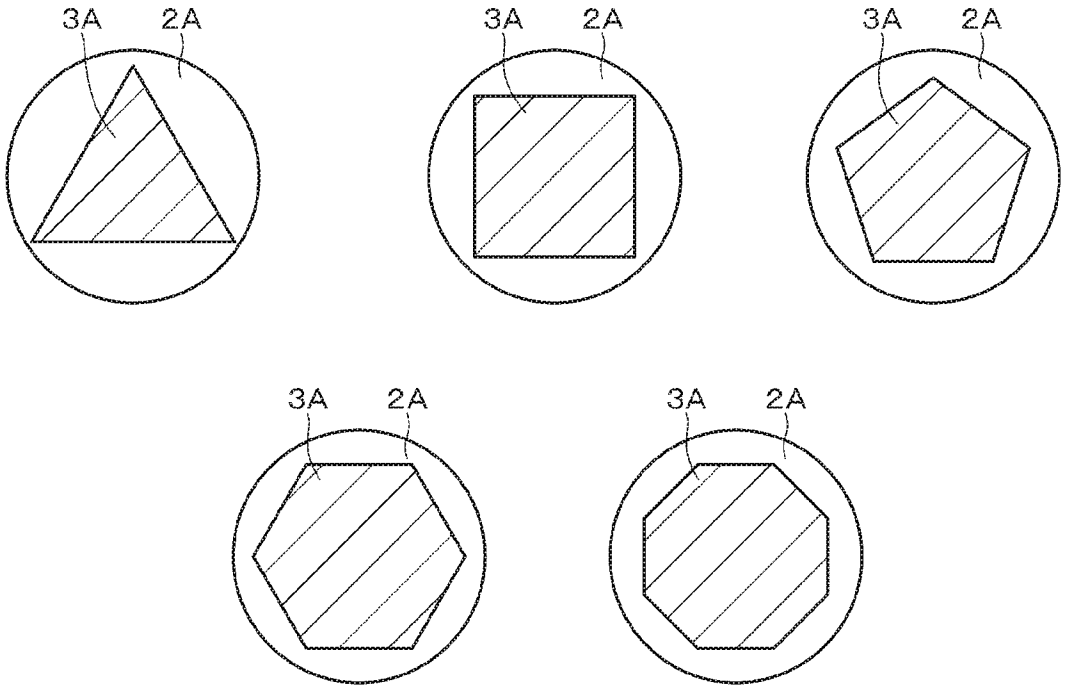
FIG. 13 is a schematic diagram showing a plurality of examples of the shape of the speaker diaphragm.
Figure 14:
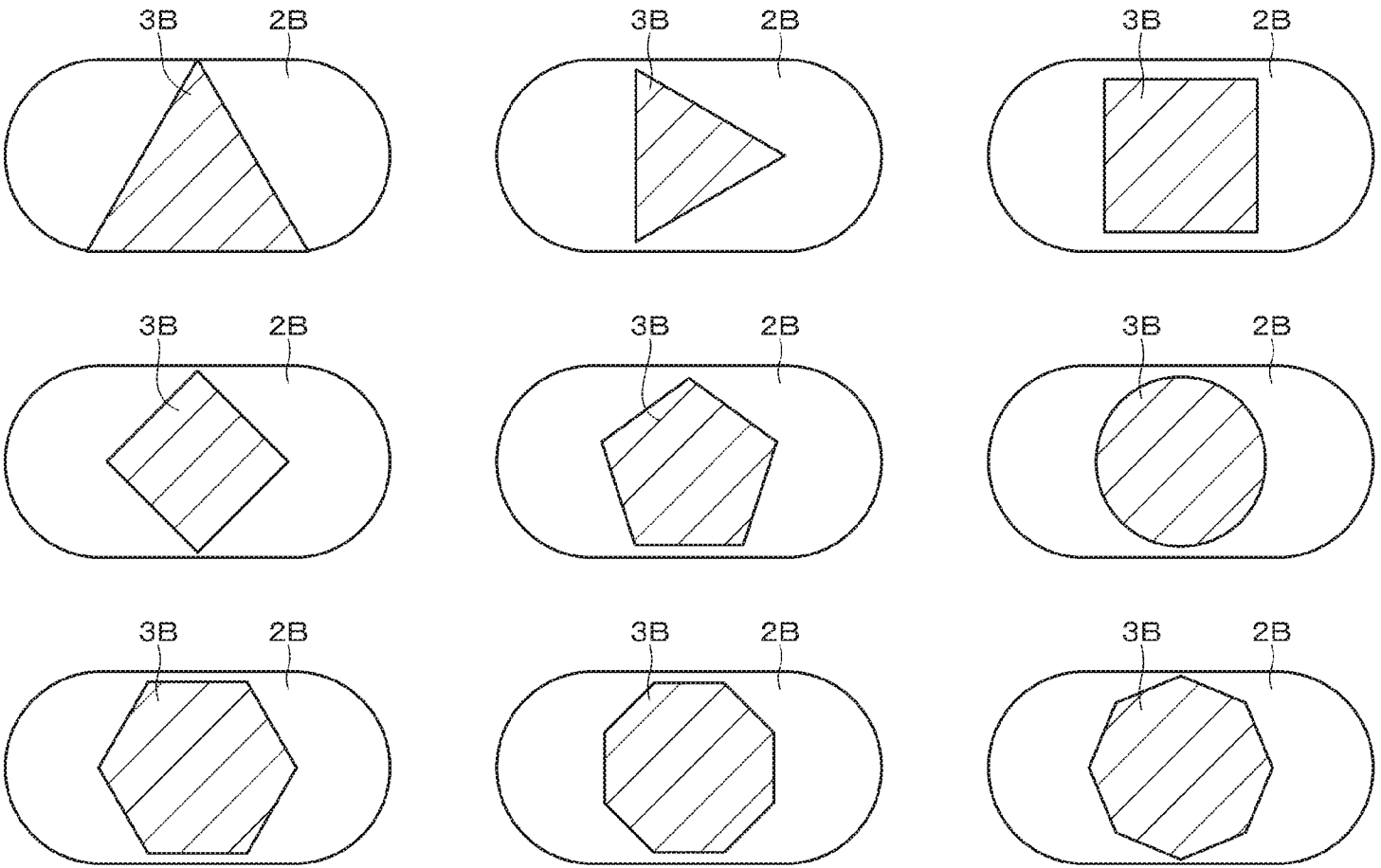
FIG. 14 is a schematic diagram showing a plurality of examples of the shape of the speaker diaphragm.

Further, as shown in FIG. 13, a flat diaphragm 2A may be circular. A flat diaphragm 3A having a shape such as a triangle, a quadrangle, a polygon, and a circle is bonded to the flat diaphragm 2A. Further, as shown in FIG. 14, a track-type flat diaphragm 2B may be used, and a flat diaphragm 3B having a shape such as a triangle, a quadrangle, a polygon, and a circle may be bonded to the flat diaphragm 2B.

2. Modified Example

Although an embodiment of the present technology has been specifically described above, the present technology is not limited to the above-mentioned embodiment and various modifications based on the technical ideas of the present technology can be made. For example, although one groove or hole is formed as the second air passage path formed on the bottom surface of the magnetic circuit, a groove or hole branched into a plurality of grooves or holes may be formed.

The configurations, the methods, the steps, the shapes, the materials, and the numerical values cited in the above-mentioned embodiment are merely examples, and different configurations, methods, steps, shapes, materials, and numerical values may be used as necessary. The above-mentioned embodiment and modified example can be appropriately combined.

The present technology may also take the following configurations.

(1)

A speaker diaphragm, including:

a first flat diaphragm; and a second flat diaphragm bonded to a back surface of the first flat diaphragm, the second flat diaphragm having an area smaller than that of the first flat diaphragm and being formed of a material whose physical characteristics are different from those of the first flat diaphragm.

(2)

The speaker diaphragm according to (1), in which the physical characteristics include a Young's modulus and/or internal loss.

(3)

The speaker diaphragm according to (1) or (2), in which the first flat diaphragm is CFRP and the second flat diaphragm is foam mica.

(4)

A speaker apparatus, including:

a magnetic circuit including an annularly formed magnet, a yoke that includes a base surface part and a center pole part protruding from the base surface part, the center pole part being disposed while being inserted into a central part of the magnet, and a plate that is annularly formed and is disposed on an outer peripheral side of the center pole part of the yoke while being attached to the magnet;

a coil bobbin that is cylindrically formed and is displaceable in an axial direction of the center pole part while a part thereof is fitted onto the center pole part of the yoke;

a voice coil that is wound around an outer peripheral surface of the coil bobbin, at least a part thereof being disposed in a magnetic gap formed between the plate and the center pole part of the yoke; and a diaphragm that is connected to the coil bobbin and is caused to vibrate in conjunction with displacement of the coil bobbin, in which a first air passage path and a second air passage path are formed, the first air passage path leading from a back surface side of the diaphragm to a lower surface of the magnetic circuit, the second air passage path being formed in the lower surface of the magnetic circuit and connecting the first air passage path and a side of the magnetic circuit.

(5) The speaker apparatus according to (4), in which the diaphragm is the speaker diaphragm according to (1).

(6)

The speaker apparatus according to (4) or (5), in which the magnetic gap is filled with a magnetic fluid, the center pole part has a recess that forms a magnetic gradient changing a magnetic flux density in a circumferential direction of the center pole part to change magnetic force on the magnetic fluid, and the recess forms the first air passage path.

(7)

The speaker apparatus according to any one of (4) to (6), in which a plurality of grooves formed on a lower surface of the magnetic circuit and a back surface plate of an enclosure disposed in close proximity to or in close contact with the lower surface of the magnetic circuit form the second air passage path.

REFERENCE SIGNS LIST

1 speaker apparatus
2, 3 flat diaphragm
7 coil bobbin
8 plate
8*a* magnetic flux change part
9 magnet
10 yoke
11 base surface part
12 center pole part
12*a* magnetic flux change part
13 magnetic flux change part
14 magnetic gap
15 voice coil

16 magnetic fluid
21 enclosure
22 notch

The invention claimed is:

1. A speaker diaphragm, comprising:
a first flat diaphragm; and
a second flat diaphragm bonded to a back surface of the first flat diaphragm, wherein
the second flat diaphragm has an area smaller than that of the first flat diaphragm,
the first flat diaphragm includes carbon fiber-reinforced plastic,
the second flat diaphragm includes foam mica, and
physical characteristics of the second flat diaphragm are different from physical characteristics of the first flat diaphragm.

2. The speaker diaphragm according to claim 1, wherein the physical characteristics of each of the first flat diaphragm and the second flat diaphragm include at least one of a Young's modulus or internal loss.

3. A speaker apparatus, comprising:
a magnetic circuit including:
a magnet having an annular shape;
a yoke that includes:
a base surface part,
a center pole part protruding from the base surface part, wherein the center pole part is in a central part of the magnet;
a first air passage path; and
a second air passage path; and
a plate having the annular shape, wherein
the plate is an outer peripheral side of the center pole part of the yoke, and
the plate is attached to the magnet;
a coil bobbin having a cylindrical shape, wherein
the coil bobbin is displaceable in an axial direction of the center pole part, and
a part of the coil bobbin is fitted onto the center pole part of the yoke;
a voice coil wound around an outer peripheral surface of the coil bobbin, wherein at least a part of the voice coil is in a magnetic gap between the plate and the center pole part of the yoke; and
a diaphragm connected to the coil bobbin, wherein the diaphragm is configured to vibrate based on displacement of the coil bobbin, wherein
the first air passage path leads from a back surface side of the diaphragm to a lower surface of the magnetic circuit,
the second air passage path in the lower surface of the magnetic circuit, and
the second air passage path extends from the first air passage path to an outer peripheral side of the base surface part in a radial direction.

4. The speaker apparatus according to claim 3, wherein the diaphragm includes:
a first flat diaphragm; and
a second flat diaphragm bonded to a back surface of the first flat diaphragm,
the second flat diaphragm has an area smaller than that of the first flat diaphragm, and
physical characteristics of the second flat diaphragm are different from physical characteristics of the first flat diaphragms.

5. The speaker apparatus according to claim 3, wherein
the magnetic gap includes a magnetic fluid,
the center pole part includes a recess configured to form a magnetic gradient,
the magnetic gradient changes a magnetic flux density in a circumferential direction of the center pole part to change magnetic force on the magnetic fluid, and
the recess forms the first air passage path.

6. The speaker apparatus according to claim 3, wherein
a plurality of grooves is on the lower surface of the magnetic circuit,
a back surface plate of an enclosure is in contact with the lower surface of the magnetic circuit, and
the plurality of grooves and the back surface plate form the second air passage path.

7. The speaker diaphragm according to claim 1, wherein a shape of the first flat diaphragm is different from a shape of the second flat diaphragm.

* * * * *